United States Patent [19]

Brown

[11] Patent Number: 5,011,044

[45] Date of Patent: Apr. 30, 1991

[54] ANTI-ASSAULT DEVICE

[76] Inventor: Arlon R. Brown, 1368 Neeb Rd., Cincinnati, Ohio 45238

[21] Appl. No.: 499,281

[22] PCT Filed: Jun. 2, 1987

[86] PCT No.: PCT/US87/01526

§ 371 Date: Dec. 29, 1989

§ 102(e) Date: Dec. 29, 1989

[87] PCT Pub. No.: WO89/00147

PCT Pub. Date: Jan. 12, 1989

[51] Int. Cl.[5] ..... B67B 7/24

[52] U.S. Cl. ..... 222/78; 222/83; 222/87; 222/175; 222/182; 222/192

[58] Field of Search ..... 222/5, 78, 80–83, 222/83.5, 85–87, 95, 103, 175, 131, 182, 183, 192, 498, 541; 206/37, 37.1, 38, 38.1, 234, 314

[56] References Cited

U.S. PATENT DOCUMENTS

| | | | |
|---|---|---|---|
| 2,830,602 | 4/1958 | Levi | 206/37 UX |
| 3,228,565 | 1/1966 | Stanzel | 222/82 |
| 4,023,712 | 5/1977 | Babiak et al. | 222/175 |
| 4,061,249 | 12/1977 | Smith | 222/78 |
| 4,135,645 | 1/1979 | Kimmel | 222/83 |
| 4,241,850 | 12/1980 | Speer | 222/78 X |
| 4,275,820 | 6/1981 | LeBlond | 222/175 X |
| 4,308,976 | 1/1982 | Speer et al. | 222/175 |
| 4,353,365 | 10/1982 | Hallworth et al. | 222/83.5 X |
| 4,374,571 | 2/1983 | Hirvela | 206/37 X |
| 4,431,118 | 2/1984 | Namdari | 222/541 X |
| 4,550,861 | 11/1985 | Fay, Sr. et al. | 222/78 |

*Primary Examiner*—Kevin P. Shaver

*Attorney, Agent, or Firm*—Wood, Herron & Evans

[57] ABSTRACT

The anti-assault device of this invention consists of a sealed, rupturable vial, a base with one set of resilient fingers to retain the vial and a second set to support the cover, and a cover having a skirt containing projections which reset upon and engage the second set of resilient fingers and having at least one projection for rupturing the vial. The rupturing projections are on the rear face so that when force is exerted against the front face of the cover the projections rupture the vial. This causes a foul smelling repulsive chemical contained therein to be released and to repel a would be attacker.

18 Claims, 3 Drawing Sheets

ANTI-ASSAULT DEVICE

BACKGROUND OF THE INVENTION

Basic to the concept of self-preservation is the instinct to protect oneself from attack by another. Over the years man has developed a number of means to ward off attack by the would-be assailant. One such means involves the use of obnoxious, repulsive chemicals in proximity to the would-be assailant which renders the environment in the immediate area so disagreeable that the assailant is forced to retire before making an attack.

There are a number of devices known for dispensing obnoxious chemicals by the would-be attack victim. Several dispense the chemical through a valve assembly by means of a pressurized gas. U.S. Pat. No. 4,241,850 discloses a fluid container located inside an article commonly worn on the person such as a piece of jewelry or a pen. The flow of obnoxious material is controlled by a safety lock means. The obnoxious material is preferably ejected under pressure. U.S. Pat. No. 4,550,861 discloses a lachrymator/dye dispensing apparatus which sprays obnoxious material under pressure through a spool valve. U.S. Pat. No. 4,061,249 discloses a dispenser ring which contains an irritant substance under pressure which is releasable upon activation of a valve assembly.

Repulsive or obnoxious material can also be dispensed without added pressure. The 4,241,850 patent, described above, also states alternatively that an article of jewelry containing a concealed chemical reservoir and a safety lock may emit the obnoxious chemical in a slow flowing or oozing manner. U.S. Pat. No. 4,275,820 discloses a protection device which consists of a deformable plastic capsule enclosing a rupturable vial which is broken by applying sufficient pressure to the capsule.

It is an object of the present invention to provide an anti-assault device which is not readily discernible as such but which is nevertheless easily accessible.

It is a further object that the device be easily activated yet be safe from accidental activation without the need for manually-operated safety lock assemblies.

It is a further object that the device be capable of delivering a sufficiently large amount of obnoxious material to virtually ensure retreat by the assailant.

These and other objects will become readily apparent from the description and claims as disclosed herein below.

SUMMARY OF THE INVENTION

The anti-assault device of this invention consists of a sealed, rupturable vial, a base with one set of resilient fingers to retain the vial and a second set to support the cover, and a cover having a skirt containing projections which rest upon and engage the second set of resilient fingers and having means for rupturing the vial.

The vial is preferably glass, but may be any other rupturable material which is inert to the obnoxious chemical and will not break absent a forced contact with the rupturing means on the cover. The vial is filled with a foul-smelling repulsive chemical, such as butyl mercaptan, and then sealed prior to placement onto the base.

The base serves both to retain the vial and to support the cover. The base comprises a plate having front and rear faces, an edge, and resilient fingers or prongs extending essentially perpendicular from the front face and positioned adjacent to the edge. At the ends of the fingers opposite the base are engaging tips; each finger has a tip which is directed either inward or outward. All the fingers are sufficiently flexible to permit movement along a radial line using manual force. The fingers having inward directed tips function to engage and retain the sealed vial. The flexibility of the fingers permits the vial to be pushed down over the inward directed tips and retained in position. The fingers having outward directed tips function to temporarily engage the cover.

The cover provides a pleasing appearance to the anti-assault device and contains the rupturing means necessary to break the sealed vial. The cover comprises a plate having front and rear faces, an edge, a skirt attached to the edge and positioned approximately perpendicular to the rear face, and rupturing means on the rear face. The front face is constructed to accept an ornamental article such as a cameo or other artistic design, thereby imparting a pleasing appearance to the anti-assault device and disguising its true function. The skirt has an inward and an outward surface, the inward surface having projections which are preferably parallel to the cover plate. These inward projections contact the fingers on the base having outward directed tips and rest thereon until pressure is applied to the front face of the cover sufficient to push the projections on the skirt over the outward directed tips of the fingers. As the projections are pushed over the outward directed tips, the rupturing means on the rear face of the cover come into contact with the sealed vial. Sufficient pressure causes the rupturing means to break the sealed vial and release the chemical onto the victim and ideally also onto the would-be assailant.

The device is simple to activate, does not alert the assailant as to its true function, especially when worn on a neck chain and serving as a piece of jewelry, and is not easily activated by accident.

These and other objectives and advantages will become readily apparent from the following detailed description of the invention and from the drawings in which:

DETAILED DESCRIPTION OF THE INVENTION

Figure 1:
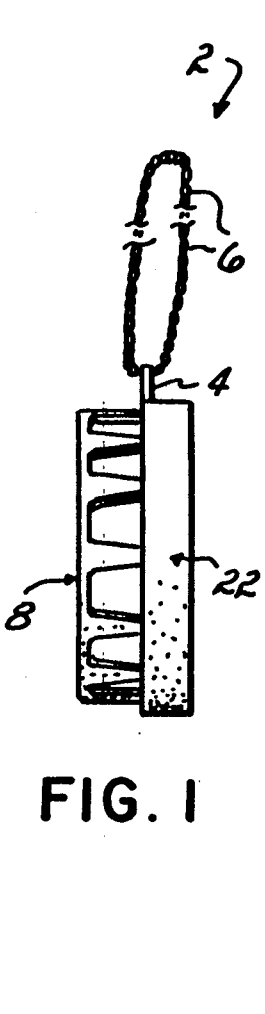
FIG. 1 is a side view of the anti-assault device shown with an attached eyelet and a chain.

FIG. 1 depicts the anti-assault device 2 having an eyelet 4 to permit the threading of a chain 6 or other chain-like article (not shown) for hanging around the neck or other portion of the body.

Figure 6:
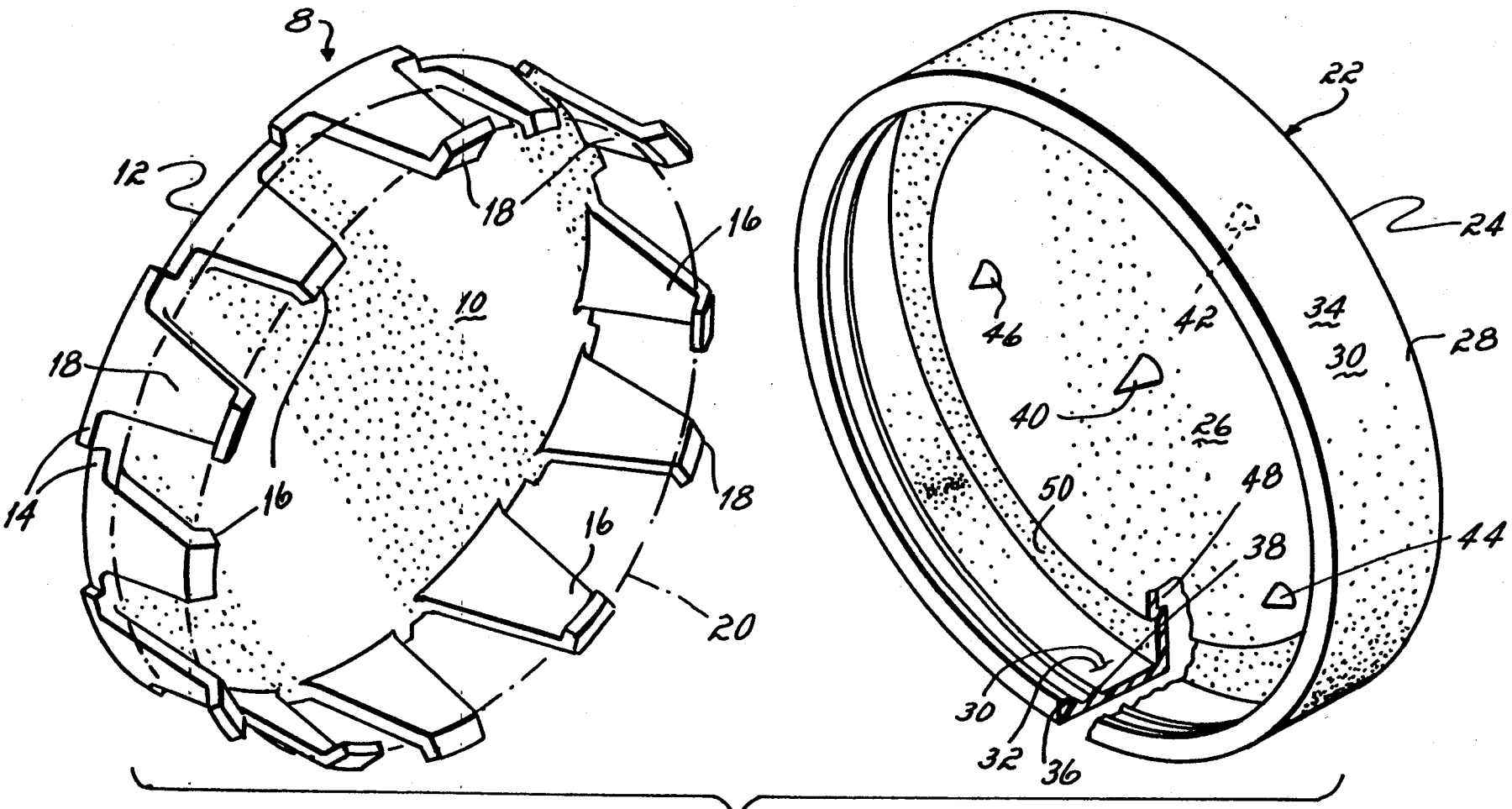
FIG. 6 is a view of the base, vial and cover prior to fixation of the cover onto the base.

The component parts of the device are shown in FIG. 6. The base 8 consists of a front face 10, a rear face 12, an edge 14, fingers having inward directed tips 16 which are otherwise called retaining fingers, and fingers having outward directed tips 18, or lid fingers.

Figure 7:
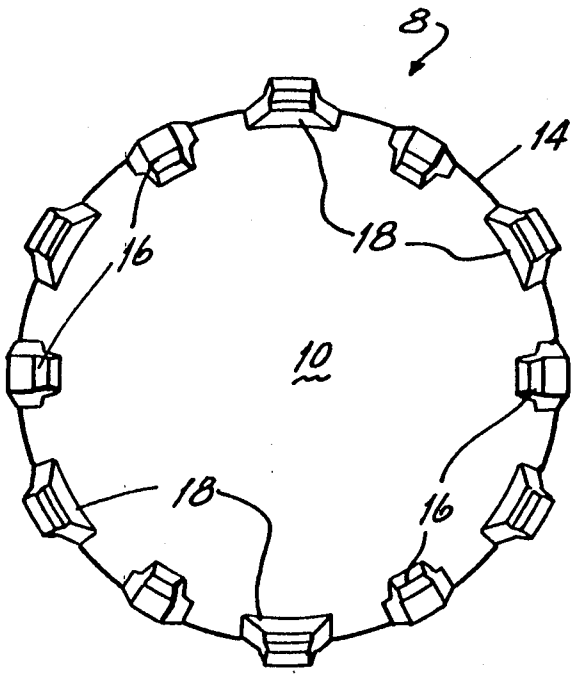
FIG. 7 is a plan view of an alternate cover.
Figure 4:
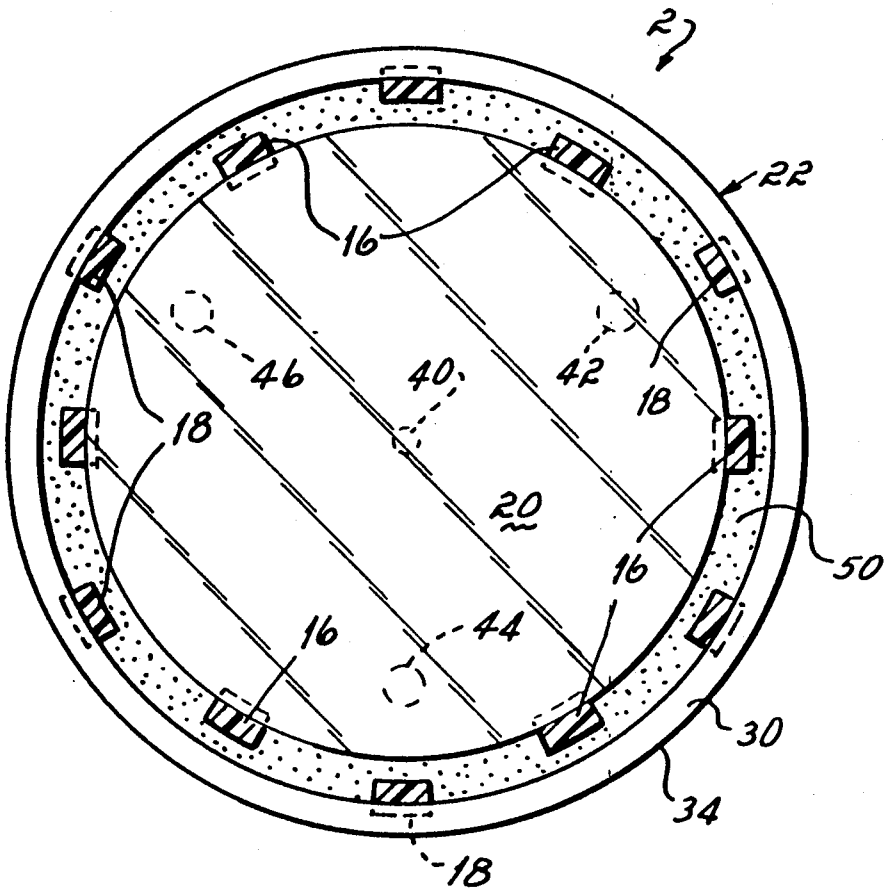
FIG. 4 is a top view of the device with the plate of the cover removed.

The fingers 16 in FIG. 6 are depicted as being closer to the center of the front face 10 than fingers 18 having outward directed tips. This is one acceptable embodiment of the invention, but it is preferred that the fingers 16 and 18 be located on the same circumferential line relative to the center of the front face 10 as depicted in FIG. 7. Where the fingers 16 and 18 are on the same circumferential line it is preferred that the edge 14 of the base 8 be smooth, as depicted in FIG. 7.

The device 2 is preferably manufactured from an injection molded plastic such as polypropylene. The characteristics of the material used to construct the device, combined with the thickness of fingers 16 and 18 of approximately 0.05 inch permit the fingers to be flexed upon application of manual force. This flexing ability allows for simple positioning and fixation of the sealed vial 20 within the fingers 16. The fingers 16 and 18 are depicted in the drawings as being evenly-spaced along the edge 14, and having alternating inward and outward directed tips in equal numbers. Though preferred, the above restrictions are not required. The retaining fingers 16 need only be positioned such that they securingly engage the vial 20, and the lid fingers 18 need be positioned to temporarily support the cover 22 and to discourage premature breaking of the vial.

Figure 8:
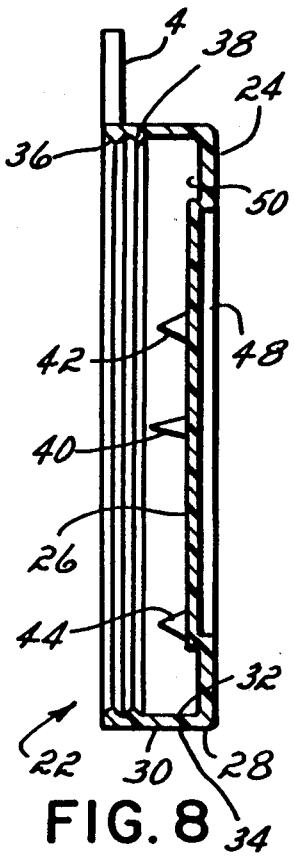
FIG. 8 is a cross-sectional view of the base.

The cover 22 is manufactured from the same resilient plastic material as the base 8, i.e., polypropylene. The cover 22 is comprised of a front face 24, a rear face 26, an edge 28, a skirt 30 having an inward surface 32, an outward surface 34, a locking projection 36, and a safety projection 38, and rupturing means 40, 42, 44, and 46. The skirt is preferably continuous as pictured in FIG. 8, and the projections 36 and 38 are preferably annular rings parallel to the front face 24. The front face 24 has in a preferred embodiment a central well 48 which preferentially accepts an ornamental article (not shown) such as a cameo. It is preferred also that the rear face 26 have molded therein a circumferential channel 50 which accepts the inward directed tips of the fingers 16 when downward force is applied to the front face 24 of the cover 22, thereby permitting more complete contact of the rupturing means 40 through 46 with the sealed vial 20.

Figure 3:
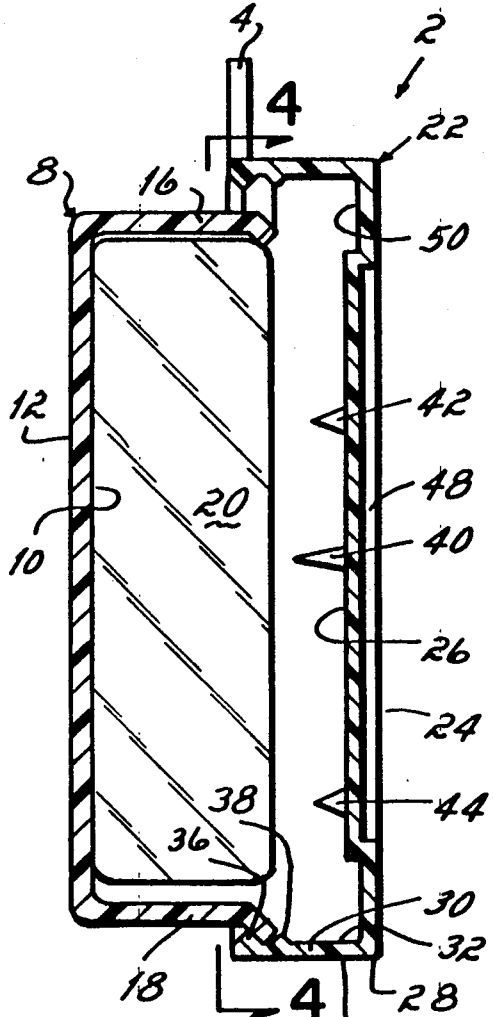
Figure 2:
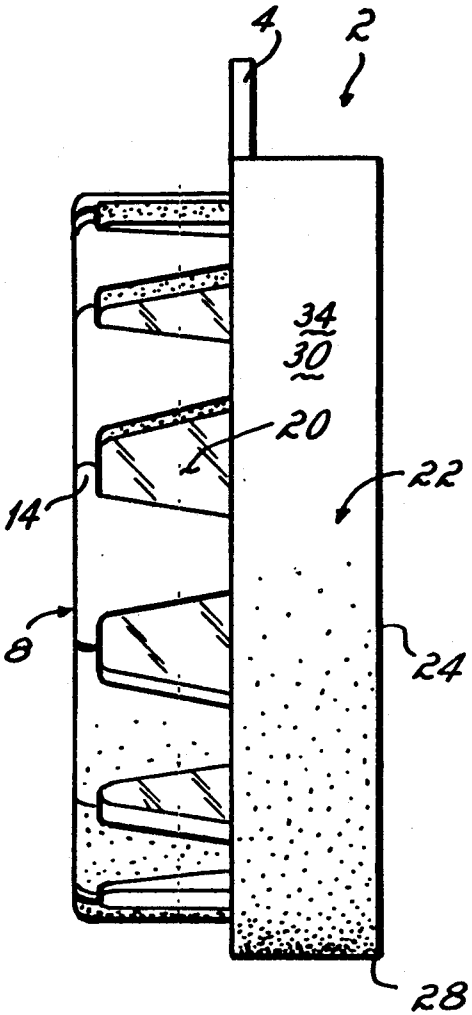
FIG. 2 is a magnified side view of the device without the chain.

As shown in FIG. 3, the cover 22 securingly engages base 8 by fitting the locking projection 36 over the fingers having outward directed tips 18 until the fingers 18 abut the safety projection 38. The cover 22 cannot be easily pulled away from the base 8 due to the restraining effect of the locking projection 36 against the fingers 18. Further movement of the cover 22 toward the base 8 is temporarily restrained by the safety projection 38. A force of approximately six to eight pounds directed against the front face 24 of the cover 22 is sufficient to move the safety projection 38 over the fingers 18 and bring the rupturing means 40 through 46 into intimate contact with the sealed vial 20. This force is easily attained by the would-be victim, but is set sufficiently high so as to prevent unintentional activation by accidental contact.

The rupturing means 40 through 46 as pictured in FIG. 6 are conical projections depending from the rear face 26. The figure shows a central projection 40 surrounded by three projections 42, 44 and 46 which in turn form the points of an equilateral triangle centered over projection 40. The central projection 40 is larger in size than the remaining projections 42, 44 or 46. This arrangement of rupturing means is preferred because it effectively breaks the sealed vial at a sufficient number of points to result in rapid deployment of the obnoxious chemical. The particular arrangement of rupturing means is preferred, but is only one of a large number of arrangements which will serve to rupture the vial 20 on contact. The rupturing means may have a different shape and may be arranged in a different pattern. Further, the number of rupturing means may vary.

Figure 5:
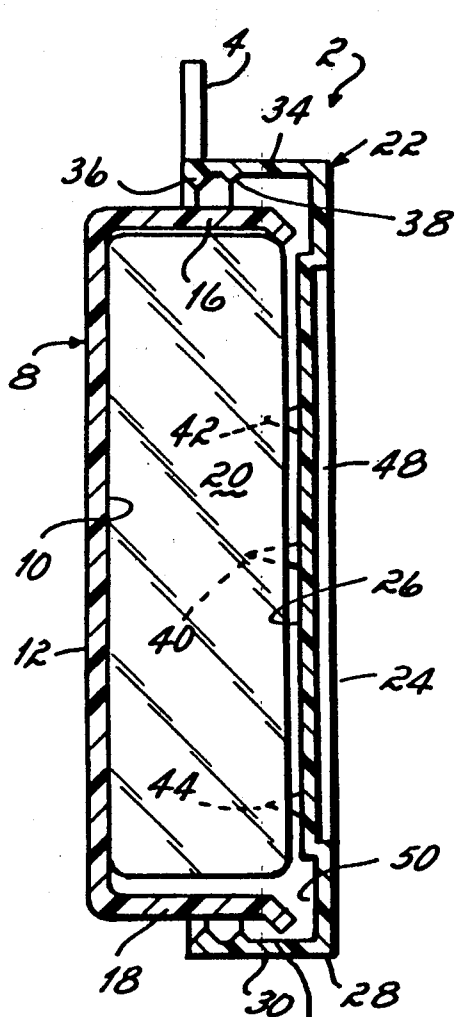
FIGS. 3 and 5 are cut-away side views of the device prior and subsequent to rupturing, respectively.

When downward pressure is applied to the front face 24 of the cover 22 in an amount sufficient to displace the safety projection 38 from the fingers having outward directed tips 18, the rupturing means 40 through 46 come into contact with the sealed vial 20 and rupture the vial, as shown in FIG. 5. The vial 20 is preferably produced from glass, and is produced by expanding molten glass into a mold having tightly controlled tolerances. The resultant vial must have dimensions which lay within a narrow range to permit successful retention by the fingers 16 on base 8. The walls of the vial must be sufficiently thick to withstand normal body movement without fracturing, yet not be so strong that an excessive amount of force is needed to cause rupture. Generally, a wall thickness of about 0.025 inches for a vial made from glass will provide the required properties. The vial in the preferred embodiment is able to deliver approximately 3½ to 4 milliliters of obnoxious chemical. This amount is more than what is necessary to render an assailant unable to remain in the same area. However, the excess volume is deemed a prudent precaution in light of the consequent risk to the victim should insufficient chemical be deployed.

The specification has described this invention and its operating parameters. Variations may be achieved without departing from the spirit and score hereof as defined by the claims.

What is claimed is:

1. An apparatus for discouraging physical attack comprising:

a rupturable sealed vial, said vial containing a liquid composition having an obnoxious odor;

a base comprising a plate having a front face, a rear face, an outer edge, and a plurality of resilient fingers attached adjacent to said outer edge on said front face and extending perpendicularly therefrom, a portion of said fingers having tips which are directed inwardly to retain said vial, and the remaining fingers having tips directed outwardly; and a cover comprising a plate having a front face, a rear face, an outer edge, a skirt having inward and outward surfaces attached to said outer edge of said plate wherein said skirt is positioned approximately perpendicular to said rear face of said plate and has projections on said inward surface which temporarily engage said remaining fingers having outwardly directed tips on said base, and means on said rear face of said plate for rupturing said vial.

2. The apparatus of claim 1 wherein said base and said cover are molded from a resilient plastic material.

3. The apparatus of claim 1 wherein at least one projection on said inward surface of said skirt is positioned in relation to said fingers having outwardly directed tips such that the pressure applied to said front face of said apparatus to rupture said vial must exceed the pressure generated by casual, accidental contact with said apparatus.

4. The apparatus of claim 1 wherein said front face of said cover contains an ornamental decoration.

5. The apparatus of claim 1 wherein said base has fitted thereto an eyelet through which flexible chain-like material may be drawn which would permit said apparatus to be hung around the neck.

6. The apparatus of claim 1 wherein said rupturing means comprise a plurality of conical points.

7. The apparatus of claim 2 wherein said resilient plastic material is polypropylene.

8. The apparatus of claim 1 wherein said base and said cover are substantially circular.

9. The apparatus of claim 8 wherein said vial is cylindrical in shape.

10. The apparatus of claim 9 wherein said fingers attached to said base are positioned along a common circumference of said base.

11. The apparatus of claim 9 wherein said fingers having tips which are directed inwardly are positioned along a circumference of said base different from that of said fingers having outwardly directed tips.

12. The apparatus of claim 9 wherein said rupturing means comprises at least one point.

13. An apparatus for discouraging physical attack comprising:

a rupturable sealed vial containing a liquid composition having an obnoxious odor;

a base comprising a symmetrically-shaped plate having a front face, a rear face, an outer edge, a plurality of evenly-spaced resilient retaining fingers attached adjacent to said outer edge on said front face, securingly engaging said vial, and a plurality of resilient lid fingers attached adjacent to said outer edge of said front face; and a cover comprising a plate of dimension similar to said base plate, having a front face, a rear face, an outer edge, a continuous skirt having inward and outward surfaces attached to said outer edge of said cover plate and positioned approximately perpendicular to said rear face of said cover plate with annular projections on said inward surface parallel to said cover plate which temporarily engage said lid fingers on said base, and means on said rear face of said cover plate for rupturing said vial.

14. The apparatus of claim 13 wherein said base and said cover assembly are molded from a resilient plastic material.

15. The apparatus of claim 13 wherein said front face of said cover contains an ornamental decoration.

16. The apparatus of claim 13 wherein said base has fitted thereto an eyelet through which flexible chain-like material may be drawn which would permit said apparatus to be hung around the neck.

17. The apparatus of claim 13 wherein said rupturing means comprise a plurality on conical points.

18. The apparatus of claim 13 wherein said resilient plastic material is polypropylene.

* * * * *